US006613119B2

(12) United States Patent
Margaria

(10) Patent No.: US 6,613,119 B2
(45) Date of Patent: Sep. 2, 2003

(54) INOCULANT PELLET FOR LATE INOCULATION OF CAST IRON

(75) Inventor: Thomas J. Margaria, Passy (FR)

(73) Assignee: Pechiney Electrometallurgie, Cedex (FR)

( * ) Notice: Subject to any disclaimer, the term of this patent is extended or adjusted under 35 U.S.C. 154(b) by 0 days.

(21) Appl. No.: 10/043,655

(22) Filed: Jan. 10, 2002

(65) Prior Publication Data

US 2003/0126947 A1 Jul. 10, 2003

(51) Int. Cl.[7] ..... C22C 1/04
(52) U.S. Cl. ..... 75/228; 75/303
(58) Field of Search ..... 75/328, 228, 303

(56) References Cited

U.S. PATENT DOCUMENTS

| | | | | |
|---|---|---|---|---|
| 2,873,188 A | * | 2/1959 | Bieniosek | |
| 3,137,570 A | | 6/1964 | Mickelson | 75/124 |
| 3,278,294 A | * | 10/1966 | Feldmann | |
| 3,527,597 A | | 9/1970 | Dawson | 75/58 |
| 3,961,663 A | * | 6/1976 | Degois et al. | 164/58 |
| 4,432,793 A | | 2/1984 | Hilaire et al. | 75/130 R |
| 4,568,388 A | | 2/1986 | Dremann et al. | 75/130 A |
| 4,666,516 A | | 5/1987 | Hornung et al. | 420/30 |
| 5,008,074 A | | 4/1991 | Naro et al. | 420/578 |
| 5,435,527 A | * | 7/1995 | Margaria | 266/216 |
| 5,690,161 A | | 11/1997 | Daussan et al. | 164/358 |
| 6,102,983 A | * | 8/2000 | Skaland | 75/568 |
| 6,293,988 B1 | | 9/2001 | Naro | 75/305 |

FOREIGN PATENT DOCUMENTS

| | | |
|---|---|---|
| DE | 43 18 309 | 12/1994 |
| WO | 95/24580 | 9/1995 |

OTHER PUBLICATIONS

Produits De Fonderie, Groupe Pechiney, Apr. 1994.
"A New Approach To Ductile Iron Inoculation", American Foundry Society 2001, T. Skaland, pp. 77–88.

* cited by examiner

*Primary Examiner*—Ngoclan Mai
(74) *Attorney, Agent, or Firm*—Joseph T. Guy; Nexsen Pruet Jacobs & Pollard, LLC

(57) ABSTRACT

A pellet, intended for the late inoculation of cast irons, obtained by agglomeration of a powdered inoculant, characterised in that the mass proportion of the granulometric fraction 50–250 microns of the powdered inoculant of which the pellet is constituted is comprised between 35 and 60%, and the mass proportion of the granulometric fraction below 50 microns is lower than 25%.

13 Claims, No Drawings

INOCULANT PELLET FOR LATE INOCULATION OF CAST IRON

FIELD OF THE INVENTION

The invention concerns the late, so-called "in mould", treatment of liquid cast irons intended for the manufacture of parts for which it is desired to obtain a structure free from iron carbides.

The treatment concerned is mainly inoculation treatment.

"In mould" treatment consists in placing the cast iron treatment product in the liquid cast iron casting system.

PRIOR ART

Cast iron is a well known iron-carbon-silicon alloy widely used for the manufacture of mechanical parts. It is known that in order to procure good mechanical properties for these parts, it is necessary in the end to obtain an iron+graphite structure while preventing as far as possible the formation of $Fe_3C$ type iron carbides which embrittle the alloy.

Thus it may be preferred for the formed graphite to be spheroidal, if a spheroidal graphite cast iron called "SG iron" or "ductile iron" is required, rather than lamellar. If a lamellar graphite cast iron called "LG iron" or "Grey iron" is required, but the essential prior condition to be met is to prevent the formation of iron carbide.

To this end the liquid cast iron is subject before casting to an inoculation treatment, which will, as it cools, favour the appearance of graphite rather than that of iron carbide.

The inoculation treatment is therefore very important. It is in fact well known that inoculation, whatever the inoculants used, has on the liquid cast iron an effectiveness which reduces with time and which, generally, has already reduced by 50% after a few minutes. To obtain maximum effectiveness, the man skilled in the art generally practises progressive inoculation, applying to this end several additions of inoculants at different stages of the development of the cast iron; the final addition is made "in mould" as the moulds are fed or even in the feed conduits of the moulds by placing in the path of the liquid cast iron inserts constituted by an inoculant material. These inserts are generally used associated with a filter; in this case they generally have a perfectly defined shape in order to be able to be fixed in the filter, most often in an adapted cavity; these inserts of defined shape are known as pellets. We will denote by the name "inoculant filter" the unit constituted by the slug and the filter.

There are two types of pellets:

"moulded" pellets obtained by moulding the molten inoculant.

agglomerated pellets obtained from a pressed powder with generally very little binding agent, or even without binding agent.

Moulded pellets are considered, by the man skilled in the art, as being the best quality; however agglomerated pellets are often preferred to them for reasons of cost.

OBJECT OF THE INVENTION

The object of the invention is a pellet, intended for the late inoculation of cast irons, obtained by agglomeration of a powdered inoculant, characterised in that the mass proportion of the granulometric fraction 50–250 microns of the powdered inoculant of which the pellet is constituted is comprised between 35 and 60%, and preferably between 40 and 50%, and the mass proportion of the granulometric fraction below 50 microns is lower than 25%, and preferably 20%. The particle size of the powder is preferably lower than 1 mm.

DESCRIPTION OF THE INVENTION

The man skilled in the art who practises inoculation at the different stages of the development of the cast iron uses products which are all the finer the later the inoculant is added in the process; the logic is that upstream the products have all the time necessary to dissolve and that when they reach the inlet of the moulds they have only a few seconds left before, solidification.

In this way, the granulometry bracket 2/10 mm is currently used in pre-inoculation, 0.2/2 mm during ladle treatment, and 0.2/0.7 mm for runner inoculation when casting the ladles. The applicant has in fact noted in the testing shop an unexpected phenomenon:

For a same dosing of inoculant, the number of graphite nuclei generated in the liquid cast iron increases with the number of inoculant particles added to the inoculant mass unit.

Therefore if two ladles of cast iron are treated in identical conditions with a same inoculant in two different particle size distributions, the cast iron treated with the finest product will contain more graphite nuclei than that treated with the coarser product; these nuclei will also be smaller in size.

The same phenomenon has been observed during an "in mould" treatment with agglomerated slugs; the cast iron treated with a slug obtained from a finer powder will contain more graphite nuclei than that treated with a pellet obtained from a coarser powder; these nuclei will also be smaller in size.

This fairly unexpected observation may have advantageous applications since it may make it possible to control the density of the graphite nuclei in the cast iron part and therefore the structure of the manufactured part.

To obtain pellets in this way which have maximum effectiveness in terms of inoculation, the applicant has been led to prepare powders at 0/1 mm having a particular internal particle size distribution defined in the following way:

Passing to 1 mm: 100%.

Fraction between 50$\mu$and 250$\mu$: 30% to 60%, and preferentially 40% to 50%.

Fraction below 50$\mu$: less than 25% and preferentially less than 20%.

A powder of this type agglomerates easily which makes it possible to operate with lower proportions of binding agent. Thus with sodium silicate which is a well-known binding agent, doses of 0.3 $cm^3$ for 100 g of powder to 3 $cm^3$ for 100 g of powder are sufficient according to the pressures employed which may vary from 50 to 500 Mpa; since the mechanical performance of the pellets is easily acquired, the pressure and binding agent percentage parameters may be used to control the dissolution speed of the pellet and not its mechanical performance.

However experience shows that the particle size distribution defined above cannot be obtained by natural crushing; the preparation of powder with this particle size distribution requires a dosing of size fractions prepared in isolation.

The inoculant composition can be obtained either by mixing powders of different elemental products, or in form of an alloy, powder, or by mixing powders of different alloys.

EXAMPLES

The following examples 1 to 5 deal with SG cast irons; example 6 deals with a case of LG cast iron.

Example 1

A batch A of commercially available agglomerated inoculant pellets of the prior art was acquired and analysed; this analysis gave:

Si=72.1%, Al=2.57%, Ca=0.52%.

Then a batch of molten inoculant of analysis as close as possible to that of the previous batch was synthesised in the induction furnace from FeSi 75 the strength of which was corrected by adding calcium silicide, aluminium then iron; this batch of inoculant was then cast in 25 g moulded pellets.

Sampling and analysis of this batch of pellets B gave:

Si=72.4%, Al=2.83%, Ca=0.42%.

Example 2

A charge of cast iron was melted in the induction furnace and treated by the Tundish Cover process by means of an alloy of the FeSiMg type with 5% Mg, 2% Ca, and 2% total rare earths (TR) at the dose of 20 kg for 1600 kg of cast iron.

The analysis of this liquid cast iron gave:

C=3.7%. Si=2.5%, Mn=0.09%, P=0.03%, S 0.003%, Mg=0.042%.

Its eutectic temperature was 1141° C.

This cast iron was used to cast parts with a unit mass of about 1 kg, placed in clusters in a 20 part mould fed by an inflow conduit in which was placed a moulded pellet supported by a filter constituted by a refractory foam with an average pore diameter of 5 mm.

The moulded pellet employed came from batch B.

The number of graphite nodules observed by metallography on the cross-section of the parts, was 184/mm$^2$.

Example 3

Example 2 was reproduced in an identical way with the sole difference that the moulded pellet coming from batch B was replaced by an agglomerated pellet according to the prior art obtained by pressing a powder to 0/2 mm obtained by natural crushing of moulded pellets taken from the same batch B as the pellet used in the previous example.

The particle size distribution of this powder was:

Passing to 2 mm 100%

Passing to 0.4 mm 42%; Passing to 0.2 mm 20%; Passing to 50$\mu$:10%, i.e. a particle size distribution quite close to that recommended in the Foseco patent EP 0.234.825.

The number of graphite nodules observed by metallography on the cross-section of the parts was 168/mm$^2$.

Example 4

Example 3 was reproduced in an identical way with the sole difference that the moulded pellet came from batch A. The number of graphite nodules observed by metallography on the cross-section of the pellets was 170/mm$^2$.

Example 5

Example 3 was repeated in the following conditions:

A 25 kg batch of moulded pellets coming from batch B was crushed to 0/1 mm.

The fractions 0.63/1 mm; 0.40/0.63 mm; 0.25/0.40 mm; 0.050/0.25 mm and 0/0.050 mm were separated by sieving.

It has been obtained: 3.5 kg of 0.63/1 mm; 3.9 kg of 0.40/0.63 mm; 4.2 kg of 0.25/0.40 mm; 7.1 kg of 0.050/0.25 mm and 6.1 kg of 0/0.050 mm.

A powder of synthesis was prepared by blending:

2 kg of 0.63/1 mm, 2 kg of 0.40/0.63 mm, 2 kg of 0.25/0.40 mm, 7 kg of 0.050/0.25 mm, and 2 kg of 0/0.050 mm.

To these 15 kg of powder were added: 150 cm$^3$ of sodium silicate and 150 cm$^3$ of 10N sodium hydroxide.

The blend obtained was used to manufacture cylindrically shaped agglomerated pellets 24 mm in diameter, 22 mm high. The pressure exerted on the pellet to shape it was 285 Mpa for 1 second.

The shaped pellets were stored at 25° C. for 8 hours in a carefully ventilated location, and were then oven-dried at 110° C. for 4 hours. The pellets obtained, of 25 kg unit mass, constituted a batch denoted batch C.

Example 3 was then repeated with pellets coming from lot C assembled with a ceramic foam filter identical to that used in example 2.

The number of graphite nodules observed by metallography on the cross-section of the parts was 234/mm$^2$.

Example 6

Example 5 was repeated in the following conditions:

A charge of 1600 kg of cast iron was melted in an induction furnace: a sample was taken of the liquid metal and analysed.

The analysis gave:

C=3.15%, Si=1.82%, Mn=0.71%, P=0.15%, S=0.08%.

Its eutectic temperature was 1136° C.

This cast iron was used to cast parts with a unit mass of about 1 kg, placed in clusters in a 20 part mould fed by an inflow conduit in which was placed a moulded pellet supported by a filter constituted by a refractory foam with an average pore diameter of 5 mm.

The moulded pellet employed came from batch C.

The number of eutectic cells observed by metallography on the cross-section of the parts was 310/mm$^2$.

What is claimed is:

1. A pellet, intended for the late inoculation of cast irons, comprising a powdered inoculant, wherein the mass proportion of the granulometric fraction 50–250 microns of the powdered inoculant of which the pellet is constituted comprises between 35 and 60%, and the mass proportion of the granulometric fraction below 50 microns is lower than 25%.

2. A pellet according to claim 1, wherein the powdered inoculant has a particle size lower than 1 mm.

3. A pellet according to claim 2, wherein the mass proportion of the granulometric fraction 50–250 microns of the powdered inoculant of which the pellet is constituted comprises between 40 and 50%, and the mass proportion of the granulometric fraction below 50 microns is lower than 20%.

4. A pellet according to claim 3, wherein the powdered inoculant used for the preparation of the pellet comprises a blend of two or more inoculant powder alloys.

5. A pellet according to claim 3, wherein the powdered inoculant used for the preparation of the pellet comprises a blend of two or more products constituting a heterogeneous inoculant.

6. A pellet according to claim 2, wherein the powdered inoculant used for the preparation of the pellet comprises a blend of two or more inoculant powder alloys.

7. A pellet according to claim 2, wherein the powdered inoculant used for the preparation of the pellet comprises a blend of two or more products constituting a heterogenous inoculant.

8. A pellet according to claim 1, wherein the mass proportion of the granulometric fraction 50–250 microns of the powdered inoculant of which the pellet is constituted comprises between 40 and 50%, and the mass proportion of the granulometric fraction below 50 microns is lower than 20%.

9. A pellet according to claim 1, wherein the powdered inoculant used for the preparation of the pellet is a blend of two or more inoculant powder alloys.

10. A pellet according to claim 1, wherein the powdered inoculant used for the preparation of the pellet is a blend of two or more products consistituting a heterogenous inoculant.

11. A pellet for late inoculation of iron comprising particles wherein said particles are all less than 1 mm in size and wherein 35–60% of said particles are between 50 and 250 microns and less than 25% are less than 50 microns.

12. The pellet of claim 11 wherein 40–50% of said particles are between 50 and 250 microns.

13. The pellet of claim 12 wherein less than 20% of said particles are below 50 microns.

* * * * *